United States Patent [19]

Harper et al.

[11] 4,189,832

[45] Feb. 26, 1980

[54] SHAVING IMPLEMENT

[75] Inventors: Allan C. Harper, Andover, Mass.; Edmund M. Buras, Jr., Silver Spring, Md.

[73] Assignee: The Gillette Company, Boston, Mass.

[21] Appl. No.: 916,679

[22] Filed: Jun. 19, 1978

[51] Int. Cl.[2] ..... B26B 19/42

[52] U.S. Cl. ..... 30/34.2

[58] Field of Search ..... 30/34.2, 70, 74.1, 81, 30/82

[56] References Cited

U.S. PATENT DOCUMENTS

| | | | |
|---|---|---|---|
| 334,115 | 6/1886 | Kampfe et al. | 30/34.2 |
| 554,823 | 2/1896 | Kampfe | 30/34.2 X |
| 1,012,039 | 12/1911 | Warner | 30/51 |
| 1,272,816 | 7/1918 | Leslie | 30/50 |
| 1,502,615 | 7/1924 | Christy | 30/34.2 |
| 1,927,971 | 9/1933 | Youmans | 30/82 X |
| 2,040,345 | 5/1936 | Taylor | 30/34.2 |
| 2,548,959 | 4/1951 | Eisenberg | 30/34.2 |
| 2,864,162 | 12/1958 | MacDonald | 30/90 |
| 3,138,865 | 6/1964 | Meyer | 30/34.2 |
| 3,263,328 | 8/1966 | Craig | 30/63 |
| 3,321,831 | 5/1967 | Harr | 30/45 |
| 3,327,887 | 6/1967 | Harr | 30/34.2 |
| 3,517,442 | 6/1970 | Regan | 30/41 |
| 3,777,396 | 12/1973 | Simonetti | 30/47 X |
| 3,909,941 | 10/1975 | Bowman | 30/47 |
| 3,939,560 | 2/1976 | Lyall | 30/34.2 |

FOREIGN PATENT DOCUMENTS

| | | | |
|---|---|---|---|
| 427645 | 4/1935 | United Kingdom | 30/81 |

*Primary Examiner*—Gary L. Smith

*Attorney, Agent, or Firm*—Richard A. Wise; Donald E. Mahoney

[57] ABSTRACT

A shaving implement for raising and holding low-lying hairs in an erect position for cutting by a blade edge and for distributing shaving force which includes resilient hair raising means spring mounted on a flange having a skin contacting surface or guard member adapted to distribute shaving force to substantially prevent stretching of a user's skin. The resilient hair raising means have barbed ends projecting beyond and substantially normal to the skin contacting surface of the flange in close proximity to the blade edge.

5 Claims, 3 Drawing Figures

40
19
21
18
38
14
36
34a
24
20
22
34
48a
16
48
66
64
46a
32
46
44a
12
54
74
44
62
56
60
42a
31
52
42
84
74
W
76
97
81
50
99
80
10
97
76
96
94
88
26
28
30

SHAVING IMPLEMENT

BACKGROUND OF THE INVENTION

1. Field of the Invention

This invention relates to safety razors and, more particularly, to safety razors adapted to erect low-lying facial hairs for efficient cutting at or above the skin line.

2. Description of the Prior Art

Conventional safety razor implements include a handle adapted to be manually held and means for mounting a blade on the handle for cutting human facial hair at or below the skin line without nicking or cutting the skin. Low-lying or very inclined and thick hairs are generally difficult to cut. To solve this problem, some safety razor implements have included a guard member arranged to have serrations or a roughened surface for stretching the skin and raising facial hair from a normal low-lying position to an erect position for cutting at or below the skin line by the blade. An example of a shaving implement having serrations adapted to grip the skin and raise the hair for cutting is disclosed in U.S. Pat. No. 3,138,865, entitled "Safety Razor Having Skin-Stretching and Guide Means," issued to E. Meyer on June 30, 1964.

U.S. Pat. No. 1,272,816 entitled "Safety Razor," issued to Graham P. Leslie on July 16, 1918, utilizes a guard in the form of a bar located some distance from a blade cutting edge so that movement of the guard over the flesh smooths wrinkles in the skin and causes the flesh to billow in front of the razor cutting edge to cause closer cutting of the beard.

Prior art shaving implements designed to cut hair below the skin line are unsuitable for use by people having facial hairs that are generally low-lying and tightly curled. Such facial hairs tend to become ingrown and cause a condition of pseudofolliculitis or inflammation of one or more hair follicles. It has been determined that a safety razor adapted to cut hair below the skin line seems to aggravate a pseudofolliculitis problem.

Accordingly, a safety razor implement is arranged to efficiently cut hair, including low-lying facial hairs, at or above the skin line without stretching or irritating the skin.

SUMMARY OF THE INVENTION

A shaving implement comprises a handle, a blade having a cutting edge, and means for supporting the blade. The blade supporting means is attached to the handle and has a flange with a skin contacting surface adapted to distribute shaving force to substantially prevent stretching of skin. Resilient hair raising means are spring mounted on the flange adjacent to the blade cutting edge for raising and holding hairs in an erect position for cutting by the blade cutting edge without substantially irritating or scratching the skin.

DESCRIPTION OF THE PREFERRED EMBODIMENT

Figure 1:
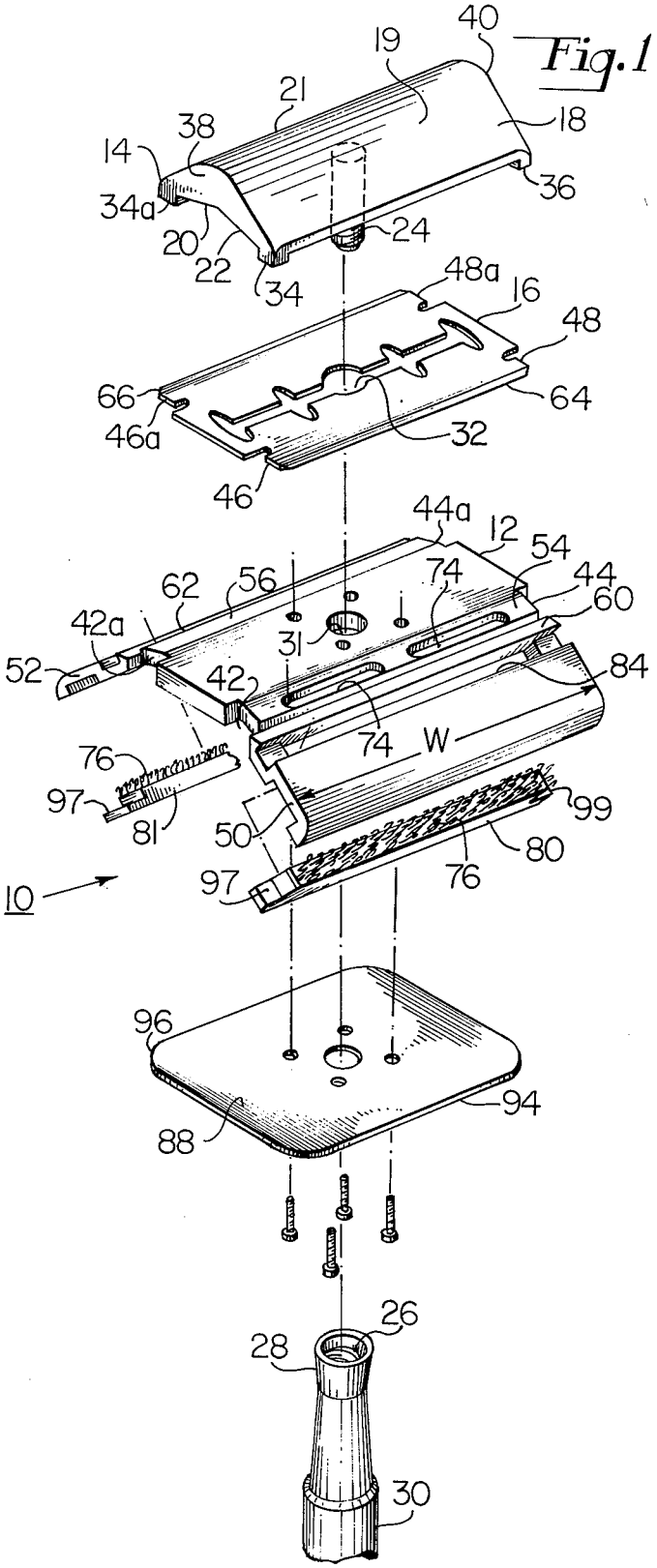
FIG. 1 is an exploded view of a shaving implement arranged according to the invention.

Referring to FIG. 1, there is shown an exploded view of a shaving implement 10 including a blade supporting means having a guard member 12 and a cap 14 arranged to support a blade 16 assembled therebetween. The cap 14 has an arcuateshaped top side 18, with surface areas 19, 21 dimensioned to distribute shaving force to minimize skin stretching when moved across a user's face. An underside of the cap 14 is formed by first 20 and second 22 oppositely inclined planar surfaces. A threaded bolt member 24 is attached to the cap 14 at the center of the cap underside. A complementary screw threaded opening 26 in the center of an end 28 of a handle 30 is intended for association with the bolt 24 for ready assembly and disassembly of the blade supporting means. The handle 30 may have a knurled outside surface to facilitate finger gripping of the shaving implement 10 by a user. The blade 16, guard member 12, and cap 14 are secured to the handle 30 by passing the bolt member 24 through an aperture 32 in the blade 16, an aperture 31 in the guard 12, and then screwing the threaded end 28 of the handle 30 to the bolt member 24. The blade 16 and cap 14 are kept in a preferred position relative to the guard member 12 by arranging the cap 14 to include pairs of substantially parallel locating members or lugs **34, 34*a*, and 36, 36*a* projecting from each of the side edges 38, 40 of the cap 14. The locating members 34, 34*a*, 36, 36*a* are situated in the plane of the cap side edges 38, 40 and are received in notches 42, 42*a*, 44, 44*a* in the guard member 12 and notches 46, 46*a*, 48, 48*a* in the blade 16 to securely hold the blade 16 and cap 14 in a preferred position relative to the guard member 12** while in use.

Figure 3:
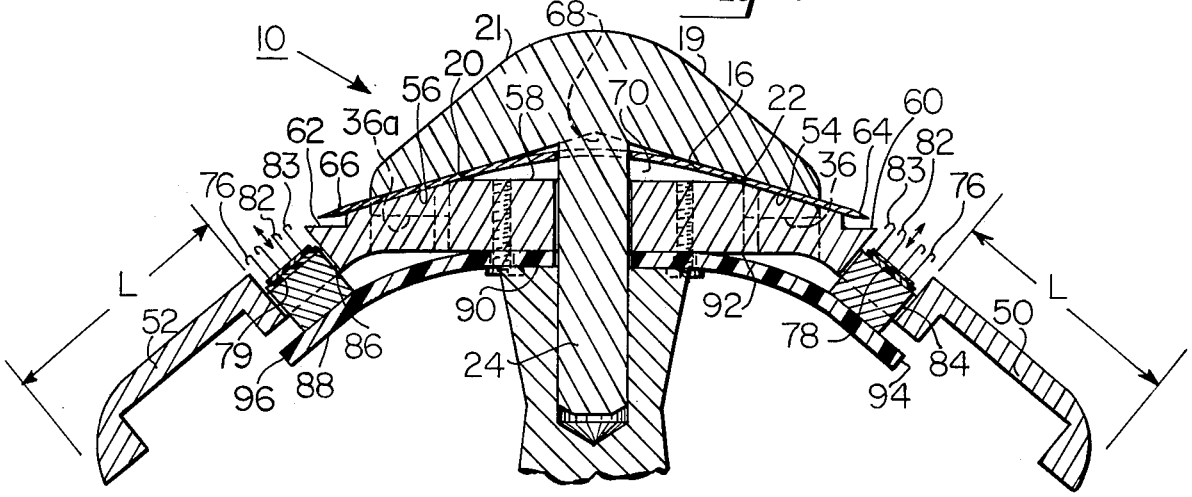
FIG. 3 is a cross sectional side view of the shaving implement shown in FIG. 2.
Figure 2:
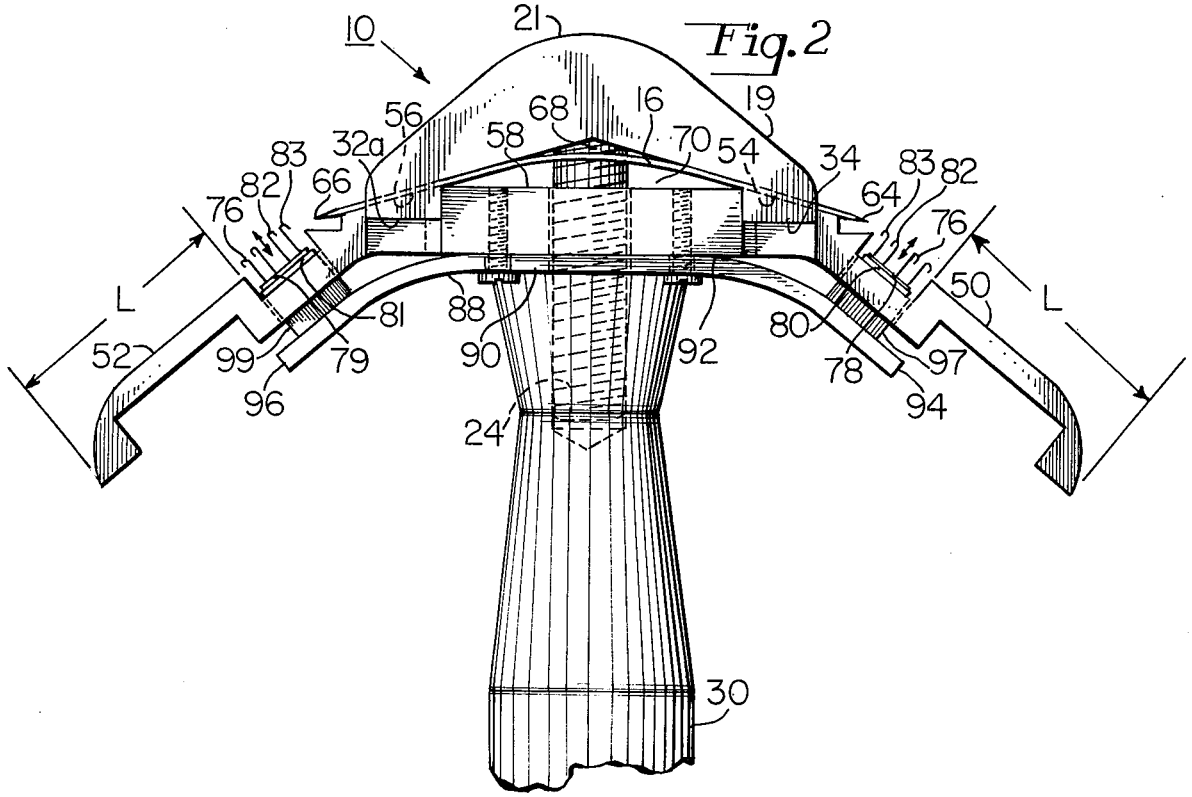
FIG. 2 is a side view of an assembled shaving implement arranged according to the invention.

Referring to FIGS. 2 and 3, there is shown a side view of an assembled shaving implement 10 and a cross sectional side view of the assembled shaving implement 10 taken along the longitudinal axis of the handle 30. FIGS. 2 and 3 show details of the blade supporting means including first and second skin contacting flanges 50, 52. The first and second flanges 50, 52 respectively extend from first 54 and second 56 oppositely inclined planar surfaces situated on either side of a third planar surface 58. The surface of the flanges 50, 52 is smooth and the width, W, and length, L, of the flanges 50, 52 are dimensioned to provide a relatively large surface area. The flanges 50, 52 are coplanar with adjacent surfaces 19, 21 of the assembled cap 14 so that the flanges 50, 52 and cap surfaces 19, 21 cooperatively act to distribute shaving force over a relatively large skin surface area to minimize stretching when the shaving implement is pulled across a user's skin. For example, in the preferred embodiment, the flange width, W, is 1.574 inches and the flange length, L, is 0.275 inch.

The oppositely inclined planar surfaces 54, 56 on the guard member 12 are arranged to cooperate with the similarly inclined planar surfaces 20, 22 on the cap underside to flex or bend the blade 16 assembled therebetween when the cap 14 is secured to the handle 30. Notches 60, 62 are formed on the guard member 12 between the third planar surface 58 and the skin contacting flanges 50, 52 to permit the blade 16 to be freely flexed during assembly without interference from the flange 50, 52. However, the blade supporting means is designed to provide the assembled blade 16 with a predetermined "blade tangent angle" and a negative blade "exposure" selected so that hair will be cut at or above the skin line.

"Blade tangent angle" is defined as the angle between the bisector of the included angle of the cutting edge and a line from the cutting edge tangent to the skin engaging surface (flanges 50, 52) immediately forward of that cutting edge. "Exposure" is defined as the distance (measured perpendicularly to a reference plane defined by skin engaging surfaces immediately in front of and behind the cutting edge) from the cutting edge to that plane, the exposure being considered positive when the cutting edge is located on the outer (skin) side of that plane and being considered negative when the cutting edge is further from the skin than that plane. A blade tangent angle of 26° and a negative blade exposure of 0.006 inch was determined suitable for cutting hair at or above the skin line.

Gaps or voids 68, 70 are provided between the flexed blade 16 and the underside of the cap 14 and between the third planar surface 58 of the guard member 12. Through holes 74 are provided in the first 50 and second 52 inclined surfaces of the guard member 12 (FIG. 1). The notches 60, 62, and the holes 74 are arranged to permit efficient flushing of shaving debris from the shaving implement 10.

Movable hair raising means are mounted on the flanges 50, 52 adjacent to the blade edges 64, 66 for raising and holding low-lying facial hairs in an upright position for immediate cutting by the blade 16 without substantially stretching or irritating the skin. As an example, the movable hair raising means comprises a plurality of spring mounted resilient filaments 76 each having an end fastened to a base material 78, 79 so as to be in an erect position. The base material 78, 79 is in turn attached to a rigid bar 80, 81 spring mounted on the guard member 12. Free ends 82 of the filaments 76 are barbed and protrude through a hole 84, 86 in the flange 50, 52 to extend beyond the planar surface of the flange 50, 52. The barbed ends 82 are intended to raise and hold normally low-lying or tightly curled facial hairs for cutting by the adjacent blade edge 64, 66 before the erected hairs can recede back to their normal reset position. It has been determined that the barbed ends 82 should not extend more than 0.025 inch beyond the planar surface of the flange 50, 52 and cap surfaces 19, 21 and a first row of barbed ends 83 should be no further from the blade edge 64, 66 than 0.064 inch in order to efficiently hold hairs in an erect position for immediate cutting. An example of resilient filament 76 suitable for use in the preferred embodiment is further described in Velcro catalogue #65 published by Velcro Corporation, Montclair, New Jersey.

Means for spring mounting the bar 80, 81 and attached resilient filaments 76 includes a leaf spring 88 having a central portion 90 fixedly attached to an underside 92 of the guard member 12 so as to provide freely movable resilient ends 94, 96. The bar ends 97, 99 are notched and normally extend beyond the flange holes 84, 86. The bar 80, 81 is inserted in the flange hole 84, 86 and then the spring 88 is assembled so that the notched bar ends 97, 99 are resiliently pressed against an underside 92 of the flange 50, 52 by a spring force provided by the leaf spring ends 94, 96. It should be understood that the leaf spring 88 permits the barbed ends 82 of the filaments 76 to reciprocally move in and out of the flange hole 84, 86 in a plane substantially normal to the flesh engaging surface of the flange 50, 52. It has been determined that spring mounting of the resilient filament 76 minimizes the possibility of the barbs 82 irritating or scratching a shaver's skin, particularly already inflammed or infected areas. In addition, spring mounting the filaments 76 enables the barbs 82 to reciprocally move in a linear direction substantially normal to a shaver's skin. It is believed that this reciprocal movement helps the barbs 82 to follow face contours and efficiently raise and hold the hairs in an erect position for cutting by the blade edge 64, 66 to a predetermined length above the skin line.

Prior art shaving implements have inflexible, roughened flange surfaces adapted to concentrate or localize shaving force in order to stretch the skin and raise low-lying hairs to an upright position for cutting at or below the skin line. Unlike the prior art, the flanges 50, 52 and the skin contacting surfaces 19, 21 of the cap 14 are arranged to have a relatively smooth and large surface area dimensioned to distribute shaving force over a relatively large surface area of skin in order to minimize skin stretching when the shaving implement is moved across a user's skin. In addition, the resilient filaments 76 are spring mounted on the flange 50, 52 with barbed ends 82 located in a preferred position near the blade edge 64, 66. The described shaving implement 10 is specifically designed to raise and hold beard hairs for cutting at or above the skin line by the blade edge 64, 66 to a length not exceeding substantially one day's growth without substantially stretching or irritating the skin.

One embodiment of the invention has been described only by way of example. Various other embodiments and modifications thereof will be apparent to those skilled in the art, and will fall within the scope of the invention as defined in the following claims.

What is claimed is:

1. A shaving implement comprising:

a handle;

a blade having a cutting edge;

means for supporting said blade, said blade supporting means being attached to said handle and having a flange with a skin contacting surface adapted to distribute shaving force to substantially prevent stretching of said skin;

resilient hair raising means mounted on said flange immediately adjacent to said blade cutting edge for raising and holding hairs in an erect position for cutting by said blade cutting edge; and spring means mounted on said implement for biasing the hair raising means.

2. A shaving implement according to claim 1, wherein said blade supporting means include a guard member and a cap arranged to support said blade assembled therebetween, said cap being adapted to cooperate with said skin contacting surface of said flange to distribute said shaving force.

3. A shaving implement comprising:

a handle;

a blade having a cutting edge;

means for supporting said blade, said blade supporting means being attached to said handle and having a flange with a skin contacting surface adapted to distribute shaving force to substantially prevent stretching of said skin; and resilient hair raising means spring mounted on said flange immediately adjacent to said blade cutting edge for raising and holding hairs in an erect position for cutting by said blade cutting edge, said spring mounted resilient hair raising means include a plurality of resilient filaments each having one end attached to a rigid bar and an unattached barbed end opposite said one end, said bar being assembled to said blade supporting means with said barbed end projecting beyond and substantially normal to said surface of said skin contacting flange, adjacent to said cutting edge; and leaf spring means attached to said blade supporting means and coupled to said bar to cause said bar to reciprocally move along a linear path in a plane substantially normal to said flange surface when said flange is moved across said skin, whereby said barbed filament end raises and holds said hairs in an erect position for cutting by said cutting edge.

4. A shaving implement according to claim 3, wherein an end of said leaf spring is arranged to flexibly press said bar against a flange surface opposite said skin engaging flange surface.

5. A shaving implement according to claim 1, wherein said barbed filament end is located no more than 0.064 inch from said blade cutting edge.

* * * * *